United States Patent [19]

Otto

[11] 4,453,8

[45] Jun. 12, 19

[54] DUMPING DEVICE FOR REFUSE CONTAINERS HAVING A DEVICE FOR OPENING THE COVER

[76] Inventor: Rolf Otto, Düringer Strasse 7, D5963 Wenden 3, Fed. Rep. of Germany

[21] Appl. No.: 316,663

[22] Filed: Oct. 30, 1981

[30] Foreign Application Priority Data

Oct. 31, 1980 [DE] Fed. Rep. of Germany ..... 3041105

[51] Int. Cl.[3] ..... B66F 3/04

[52] U.S. Cl. ..... 414/411

[58] Field of Search ..... 414/403, 406, 408, 411, 414/414

[56] References Cited

U.S. PATENT DOCUMENTS 2,087,536 7/1937 Feidert ..... 414/414

4,239,437 12/1980 Naab ..... 414/

*Primary Examiner*—Robert G. Sheridan

[57] ABSTRACT

A dumping device for refuse containers at a refuse lecting station, particularly adapted for use with a fuse container having a device for opening the cove the refuse container, the device consisting of at least stop pin, stop bolt or stop projection which is attac at the side of the cover, which engages the dump device during the lifting and/or tilting movement of refuse container and engages into a guideway provi at the dumping device. Depending on the construct of the dumping device, whether it operates with the of a lifting movement or only with the aid of a til movement, the device for opening the cover of refuse container may be adapted to the special type refuse containers.

10 Claims, 8 Drawing Figures

DUMPING DEVICE FOR REFUSE CONTAINERS HAVING A DEVICE FOR OPENING THE COVER

Figure 1:
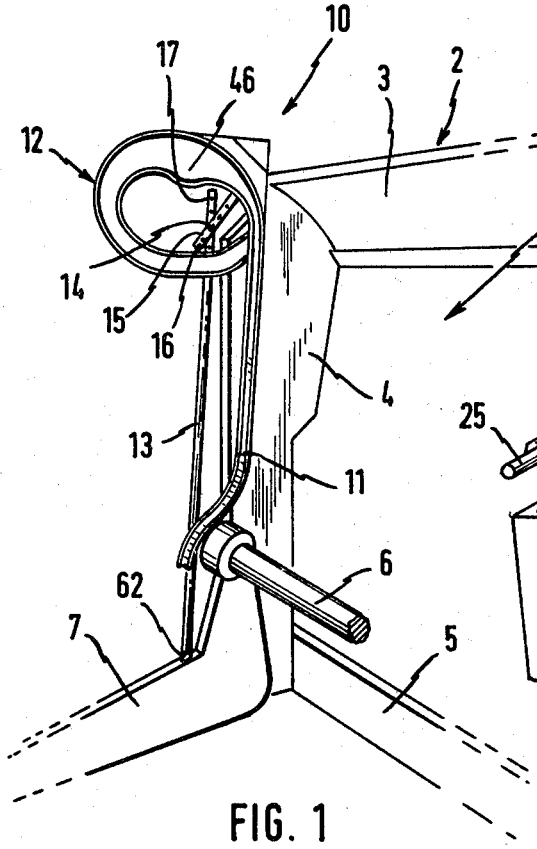

This invention relates to a dumping device for refuse containers at a refuse collecting station, to be used particularly at a refuse collector having a device for opening the cover of the refuse container, said device consisting of at least one stop pin, stop bolt or stop projection which is attached at the side of the cover, can be caused to engage the dumping device during the lifting and/or tilting movement, and engages into a guideway provided at the dumping device.

Depending on the construction of the dumping device, whether it operates with the aid of a lifting movement or only with the aid of a tilting movement, the device for opening the cover of the refuse container is adapted to the special types of the refuse containers.

In case of refuse containers being square in cross-section, the device for opening the cover is usually differently constructed as compared with refuse containers being round in cross-section.

The size of the refuse container has an influence on the construction of the device for opening the refuse container cover. That is to say, it is known that in case of refuse containers of large size having e.g. a volume of 1.1 $m^3$ in dependence on the construction of the cover an opening of the latter has to be performed in different ways. Whereas in case of refuse containers having a hinged cover attached to its one side the opening of the cover of this refuse container has to be carried out manually prior to the lifting and tilting movement, in case of another refuse container, for example as shown in the DE-OS No. 26 27 949, which has a pivoted cover, there is provided at the side of said cover a stop pin which during the tilting movement engages into a guideway or guide recess at the dumping device and thereby opens the cover at least as far as to permit immediate discharge of the refuse.

The invention has been based on the problem for a dumping device for refuse containers of the initially described type to provide a device which for all the commonly used refuse containers, above all for those having a rectilinear stop bar or engaging bar, makes possible guidance of the cover during lifting movement and automatic opening of the cover.

The problem has been solved by inventively causing the curved guideway receiving the stop pin or the like during the lifting movement to cooperate with a guide loop opening the cover.

This arrangement makes it possible that even large-size refuse containers, for example, having a volume of 1.1 $m^3$ and a hinged cover are opened automatically and necessarily.

This device is of course without having to be modified suitable to open also the so-called large-size refuse containers having a pivoted cover; it is in this case only necessary that at the side of the cover, there is attached the respective stop pin, stop bolt or stop projection. The mirror-inverted embodiment of this opening device can also be provided on the opposite side of the dumping device.

According to a preferred embodiment of the invention, the guide bar and the guide loop which are connected to each other are together movable with regard to the refuse collector station. At least the guide loop can be of U-shaped cross-section. The guide loop has preferably at least one enlargement of the cross-section.

If the dumping device is provided with two catching arms which in neutral position project approximately vertically from the refuse collector station, a guide linkage is usefully connected between the catching arm and the guide loop.

By means of this guide linkage, the opening device is to be swung out during the lifting and tilting movement of the refuse container so that any parts projecting laterally from the body of the container, such as the wheels of the refuse container, do not "cling to" the guide bar. The above mentioned cross-sectional enlargment of the guide loop serves for preventing the compulsory guide from being a hindrance when the refuse container engages into the longitudinally-slit catching arm so as to assume the tilting position, i.e. that the cross-sectional enlargement permits a "lowering" of the refuse container just at that moment of the lifting and tilting movement when the refuse container engages into the slits of the catching arms.

The guide linkage quite usefully consists of an approximately perpendicular rod extending from the catching arm to the guide loop and a guide rod connected thereto, the other end of said guide rod being coupled to the guide loop. The above mentioned swivelling of the opening device in dependence on the lifting and tilting movement of the refuse container is accomplished by the just described manner.

The rod can be arranged at the outer side of the catching arm in the region of the tilting shaft of the dumping device. In order to achieve the required lever action, the distance to the tilting axis should not be too small; since on the other hand one uses also catching arms which can be swivelled into the plane of the dumping opening, it is necessary to avoid too large a distance between tilting axis and linking point of the rod.

If it is desired to adjust the lever action at the guide linkage, it is possible to provide at least the guide rod at its end connected to the rod with holes for permitting adjustment of the distance to the joint at the guide loop; the end of the rod extending to the guide rod has preferably to be provided with several holes.

Figure 2:
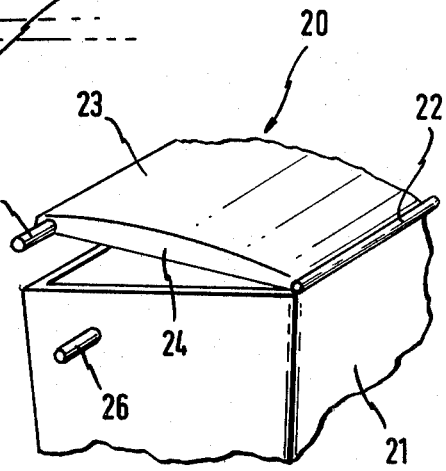
Figure 3:
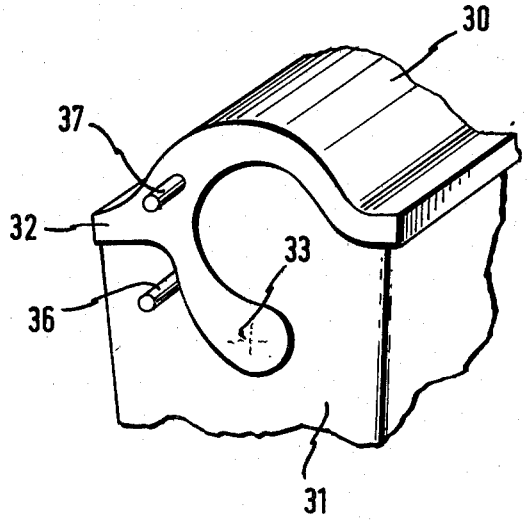
Figure 4:
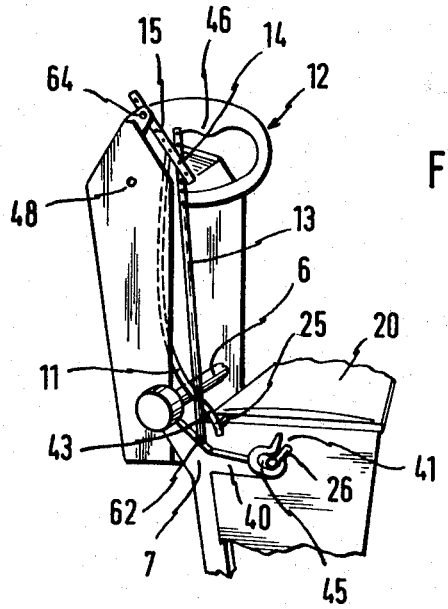
Figure 5:
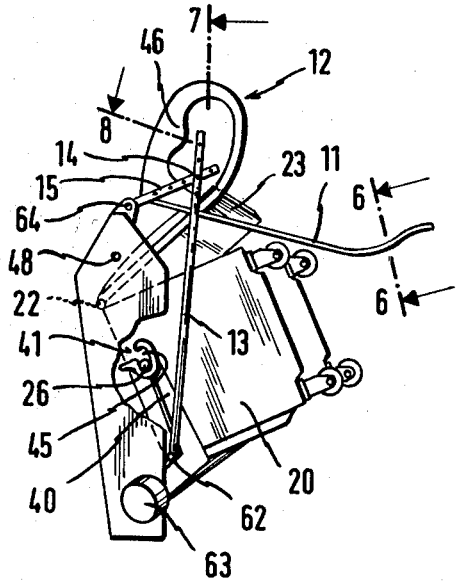
Figure 6:
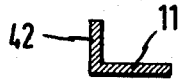
Figure 7:
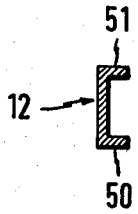
Figure 8:
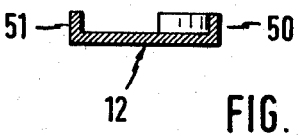

The drawing shows an exemplifying embodiment of the invention; it will hereinafter be described in more detail; it is shown in FIG. 1 an oblique view onto an embodiment of the invention;

FIG. 2 a partial view onto a refuse container;

FIG. 3 a partial view onto another refuse container;

FIG. 4 an oblique view onto the embodiment shown in FIG. 1 with the refuse container being just engaged;

FIG. 5 an oblique view similar to that of FIG. 4, however in tilting position of the container; and FIGS. 6 to 8 cross-sections along the lines 6—6, 7—7, and 8—8 according to the respective arrows in FIG. 5.

A rectangular dumping opening 1 at a refuse collector (not shown) is framed by a frame 2 whose upper part 3 is connected to a vertical part 4 and which is closed by a lower frame portion 5.

A tilting shaft 6 having at either side catching arms 7 is attached to the frame 2. Since only one opening device at one side of the dumping device is shown, the second catching arm is not shown either. However, it is proceeded on the assumption that the dumping device is provided, at the frame portion opposite to the frame portion 4, with a mirror-inverted opening device such as generally indicated by 10.

The opening device 10 has a curved guide bar 11, whose ranges of curvature will hereinafter be described in more detail, and to which is added a guide loop 12.

At the outside of the catching arm 7, there is linked a rod 13 which via a joint 14 is connected to a guide rod 15. The free ends 16 and 17 of the rod 13 and the guide rod 15, respectively, are provided with holes which in case of need serve for increasing or reducing the lever action during pivoting of the opening device 10, which lever action will hereinafter be described in more detail.

The dumping device 1 and consequently also the opening device 10 in case of the shown embodiment are preferably provided for the so-called large-size refuse containers having a volume of 1.1 $m^3$; one part of such a large-size refuse container 20 is shown in FIG. 2. This refuse container has a rectangular cross-section and on the one side of the body 21 is provided with a hinge 22 to which a cover 23 is linked. The cover 23 at its one side 24, i.e. near its front edge, has a stop bolt 25; it is obvious that at the side opposite to the side 24 of the cover 23 there can also be provided a corresponding stop pin.

FIG. 3 shows also a large-size refuse container 30 having a volume of 1.1 $m^3$ at the body portion 31 of which there is provided a pivoted cover 32 which can be pivoted about bolts 33 arranged at the opposite sides of the body portion.

In order to make possible the automatic opening of the cover 23 of the container 20, which will hereinafter be described in more detail, the refuse container is in a commonly used manner put into the catching arms 40, i.e. such that the pins 26 at the container 20 or the pins 36 at the container 30 are put into the opening 41 of the catching arms which are arranged mirror-invertedly and are connected to the tilting shaft 6.

It is irrelevant in which manner the refuse container 20 is maintained in the position shown in FIG. 4; one can in a usual manner provide a tilting chair, however, one can also provide a bar to hang the container thereon.

When putting the refuse container 20 in the position shown in FIG. 4, the stop pin 25 comes into contact with the lower end of the guide bar 11; as can be seen from FIG. 6, this guide bar is provided with a L-shaped cross-section so that the leg 42 of the guide bar 11 provides for preventing the stop pin 25 from deviating laterally.

During the initial lifting movement of the refuse container, the stop pin "rolls" on the guide bar—as shown in FIG. 5—in a slightly curved initial phase such that it is compulsorily guided via the convex region 43.

When the lifting movement is being continued and the tilting movement is gradually beginning, the guide pin 25 is first led to the guide loop 12.

The guide loop 12 throughout has a U-shaped cross-section, as can be seen for example from FIG. 7 or FIG. 8. The two legs 50 and 51 provide for preventing the stop pin 25 from leaving its compulsory guide, this in case of the embodiment of the refuse container as shown in FIG. 2 resulting in that the cover assumes a position, as indicated in FIG. 5, in the tilting position. It is with certainty avoided in this way that the cover is a hindrance during discharge of the refuse.

When a refuse container as shown in FIG. 3 is used, the swivel arm 32 has to be swung out only by an opening angle of slightly more than 90° so that in this case movement of the cover is much reduced as compared with the movement of the hinged cover 23.

The cross-sectional enlargement in the guide loop 12 as shown in FIG. 5 serves for permitting, during tilting of the container, the engaging pin 41 of the latter to slide down in the longitudinal slit 45, as can be seen from FIG. 5, so that the container 20 in tilting position can be reliably held by the catching arms 40. Since the change of the position of the engaging pins 41 causes a relative lowering of the refuse container in the longitudinal slits 45, it is necessary that the compulsory guide for the stop pin 25 is permitted to follow this movement; the bulge 46 in the guide loop 12 serves for this purpose.

The guide loop 12 and the guide bar 11 are mounted in the frame 2 of the refuse collector such that pivoting of the whole opening device about a hinge 48 is possible. In order to make possible this pivoting of the guide loop 12 and of the guide bar 11, in case of the embodiment shown there is provided a guide linkage 13, 14, 15. This guide linkage causes, in dependence on the tilting movement of the catching arm 40, a pivoting of the opening device 11, 12 about the hinge 48.

As can be seen from FIG. 5, the pivoting of the opening device 11, 10 about the hinge 48 results in that during tilting position the bar 11 extends approximately in horizontal direction. In order to prevent any laterally projecting edge portions of the body of the refuse container 20 to get into the plane of the guideway 11, pivoting of the opening device 11, 12 is carried out more rapidly than the tilting movement of the refuse container. The determining factor therefor on the one hand is the distance between the linking point 62 and the axis of rotation 63 of the tilting shaft 6 and on the other hand is the effective length of the guide rod 14 between its linking point 64 at the guide bar and the linking point 15.

That is to say, when the container 20 is being pivoted from the position shown in FIG. 4 to the position shown in FIG. 5, i.e. by about 130° to 140°, the cover 23 is compulsorily opened by the opening device and the compulsory guidance of the stop pin 26 or the respective stop pin 37 provided at the container 30, the opening angle in this case being about 250°. Simultaneously, the opening device, i.e. the guide bar 11 and the guide loop 12, are swivelled by about 90°.

It is obvious that the described opening device can be used with all types of refuse containers, preferably for refuse containers having a rectangular turning bar or a rectangular engaging bar to hang on the container. However, the opening device can be used also with round refuse bins; but in this case, the stop pin or the stop projection should be provided at the widest location of the cover. Even if the guide linkage provides for an optimum cooperation of all the provided swivelling movements, it is possible to provide a curved guideway—particularly for light refuse containers—which results in that the cover is opened compulsorily without making necessary pivoting of the opening device.

I claim:

1. A dumping device for refuse containers at a refuse collecting station, particularly a refuse container having a hinged cover and at least one stop projection attached to the side of the cover, comprising a curved guideway adapted to receive said stop projection; a pivotable lifting arm adapted to raise said refuse container; and a hinged arm coupled between said pivotable lifting arm and said curved guideway, thereby causing said guideway to open said cover while said refuse container is raised.

2. The device of claim 1, wherein said curved guideway further comprises a guide loop, said guide loop being positioned to further open said cover during the raising of said refuse container.

3. The device of claim 2, wherein said guide loop has a U-shaped cross section.

4. The device of claim 3, wherein said guide loop has at least one cross-sectional enlargement.

5. The device of claim 2, wherein said guide loop is constructed as a closed loop.

6. The device of claim 2, wherein said guideway further comprises a bar coupled at one of its ends to said guide loop and having its other end curved.

7. A dumping device for refuse containers at a refuse collecting station, particularly a refuse container having a hinged cover and at least one stop projection attached to the side of the cover, comprising a curved guideway adapted to receive said stop projection; a guide loop connected to said curved guideway, and a pivotal hinge connecting said guideway and guide loop for pivotal motion about an upper edge of said dumping device, said guideway and said guide loop cooperating in engagement of said stop projection to open said cover.

8. The device of claim 7, further comprising two catching arms having a first position extending approximately horizontally and a second raised position, a linkage pivotally connected between one of said catching arms and said guide loop and said curved guideway, said linkage effecting pivotal motion of said guideway and guide loop about said hinge when said catching arms are moved to said second raised position.

9. The device of claim 8, wherein said linkage further comprises a first rod connected to said catching arm and a second rod connected to said guide loop, said first and second rods being also connected together.

10. The device of claim 9, wherein said first and second rods have multiple connecting holes and are thereby adaptable for multiple interconnections.

* * * * *